United States Patent [19]

Whitman

[11] Patent Number: 4,538,530

[45] Date of Patent: Sep. 3, 1985

[54] BURNER FOR THE SUSPENSION FIRING OF COMMINUTED MATERIAL

[76] Inventor: John E. Whitman, 921 Lakeridge Dr., Olympia, Wash. 98502

[21] Appl. No.: 108,584

[22] Filed: Dec. 31, 1979

[51] Int. Cl.[3] ..... F23C 1/02; F23C 1/04

[52] U.S. Cl. ..... 110/260; 110/244; 110/263; 110/346; 110/347; 431/284; 431/285; 431/347

[58] Field of Search ..... 110/260, 261, 252, 263, 110/264, 265, 347, 244, 346; 431/284, 285, 8, 9, 347

[56] References Cited

U.S. PATENT DOCUMENTS

| | | | |
|---|---|---|---|
| 3,830,172 | 8/1974 | Hindenlang | 110/244 X |
| 3,837,303 | 9/1974 | Baardson | 110/244 |
| 4,021,188 | 5/1977 | Yamagisai et al. | 431/10 X |

*Primary Examiner*—Edward G. Favors
*Attorney, Agent, or Firm*—Thomas W. Secrest

[57] ABSTRACT

This invention is directed to the suspension firing of a comminuted combustible material and the supporting structure for such suspension firing. The combustible material is introduced to a burner head which results in the combustible material expanding in a circular pattern. Inside of this circular pattern there is an outwardly directed flame to contact the combustible material. The result is an immediate ignition of the combustible material and the complete burning of the combustible material. There is also a refractory near the burner head. After the refractory has been heated to a desired temperature the outwardly directed flame can be discontinued and the heat energy from the refractory material is sufficient to assist in the immediate firing of the combustible material. A result of this is that an auxiliary fuel such as fuel oil or natural gas is not required, after the refractory has reached the desired temperature to sustain combustion of the combustible material. Further, with the complete burning of the combustible material there is less possibility of particulate matter being introduced into the atmosphere as pollutants and also less possibility of particulate matter condensing out on boiler tubes in a furnace. Another factor of this invention is that the burner head and supporting equipment can be removed from the hot furnace and repaired outside the hot furnace or another burner head can be introduced into the hot furnace. This means that it is not necessary to cool the hot furnace before working on the burner head.

12 Claims, 10 Drawing Figures

200
202
204
206
208
210
212
214
216
218
220
222
224
226
228
230
232
234
236
238
240
242
244
246
248
250
252
254
256
258
26
30
32
42
52
64
66
68
70
72
76
78
96
130
136
140
142
144
146
148
150
154
156
160
162
170
172
174
176
178
180
182
188
190

BURNER FOR THE SUSPENSION FIRING OF COMMINUTED MATERIAL

A BRIEF SUMMARY OF THE INVENTION

This invention is for the suspension burning of comminuted combustible materials, such as cellulose based products or rubber based products, in any direct fired heat exchanger such as a boiler furnace or a rotary kiln.

There is a burner head which diffuses or mixes the comminuted combustible materials into a stream of combustion air. As long as ambient temperatures are high enough, ignition will take place immediately on mixing.

The burner head is provided with an ignition system firing a flammable gas in a ring type burner.

Initially, the burner head is heated by the burning of the flammable gas and also the burning of the comminuted combustible material. The refractory around the burner head increases in temperature and when a sufficiently high temperature is reached the flammable gas is no longer introduced into the burner head. The comminuted combustible material is introduced into the burner head and dispersed. The radiation and convection of heat from the refractory continues the flame propagation of the comminuted combustible material. The combustible material continues to burn and to give off heat energy.

Further, the flame pattern around the burner head can be varied over a considerable range and the penetration of the air can be controlled into the comminuted material so as to achieve a desired flame pattern.

The burner head is so designed that it can be removed from a hot furnace. It is not necessary to cool the furnace in order to remove the burner head. In fact, the burner head can be removed from the hot furnace, repaired, and reinserted into the hot furnace or another burner head can be inserted into the hot furnace, without cooling the hot furnace.

Also, there can be a wide variation in the ratio of air to combustible material introduced into the hot furnace and around the burner head.

THE DRAWINGS

Figure 1:
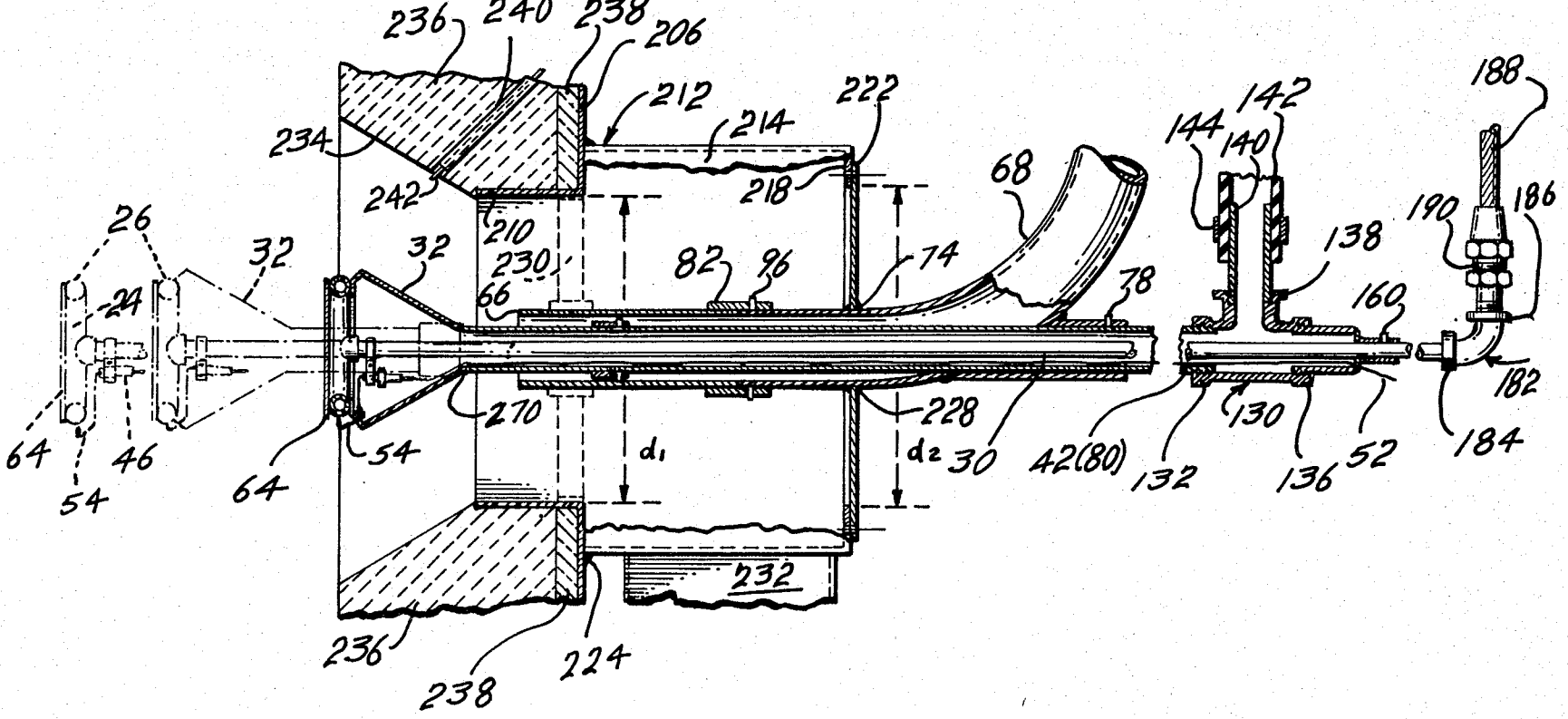
Figures 2, 3:
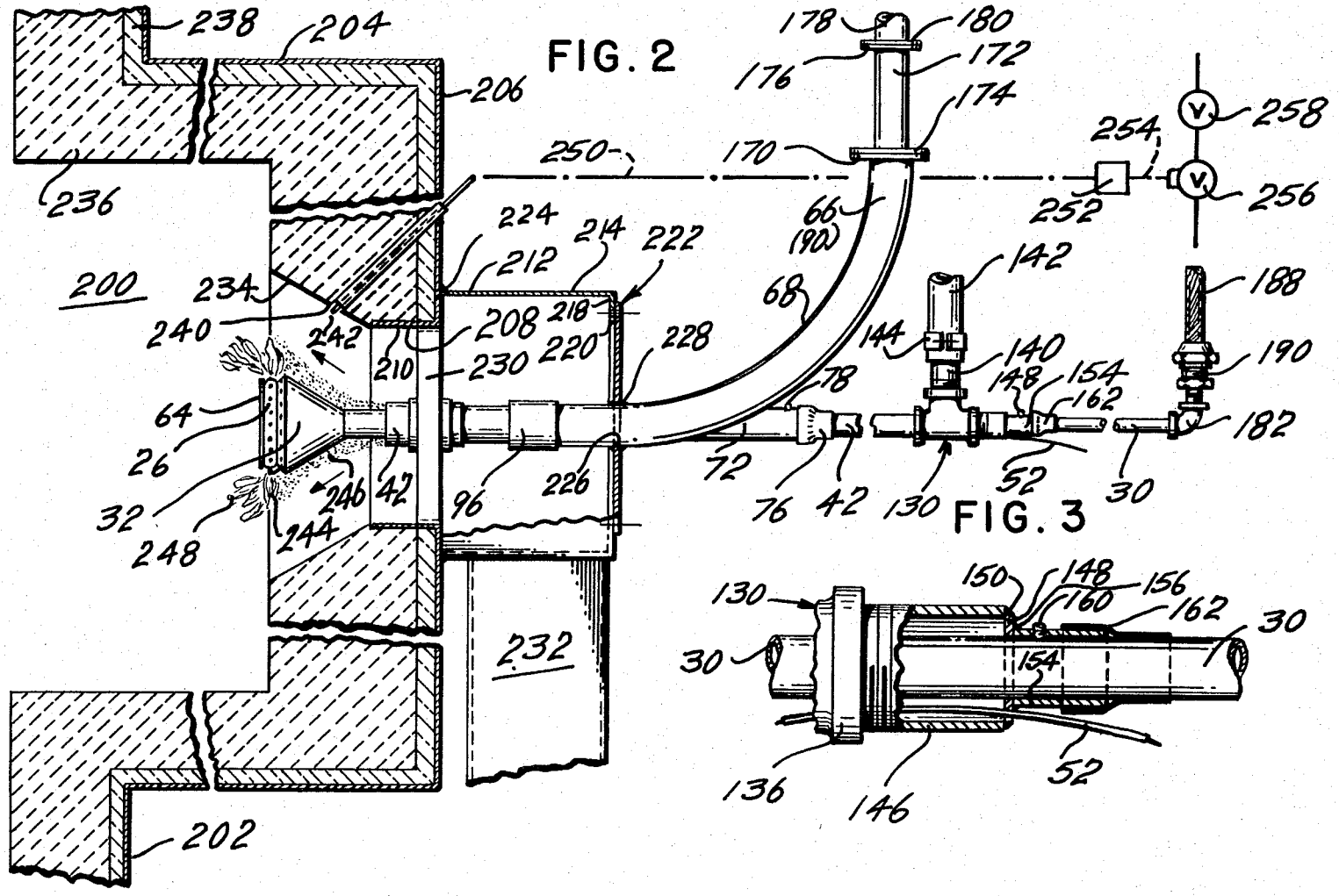
Figure 4:
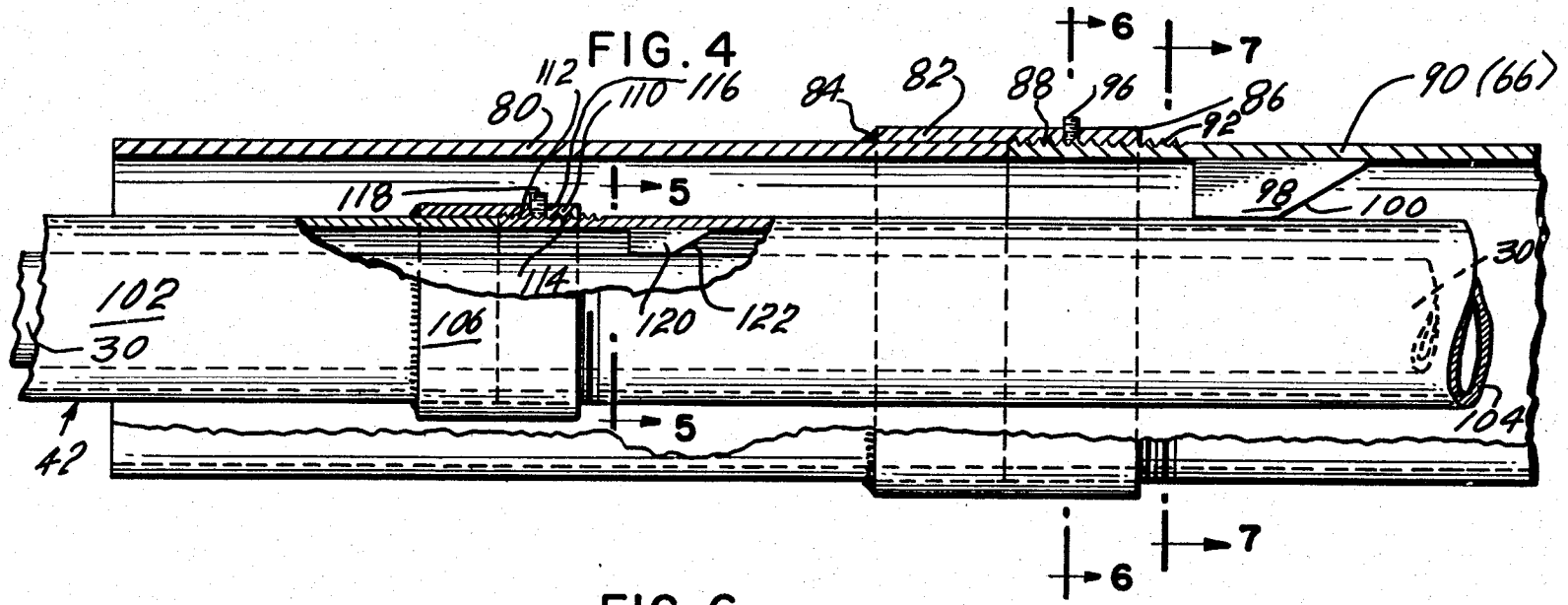
Figure 7:
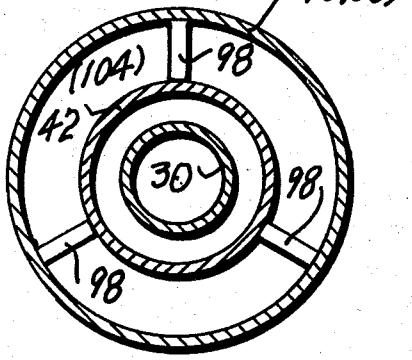
Figure 6:
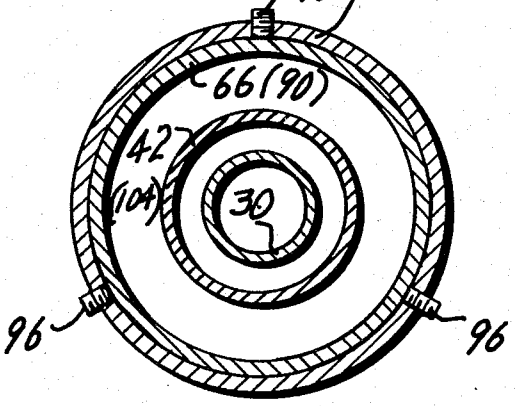
Figure 5:
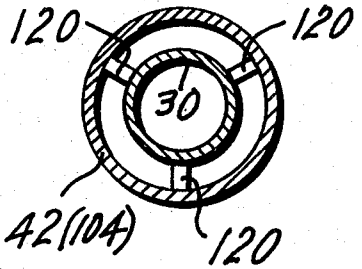
Figure 8:
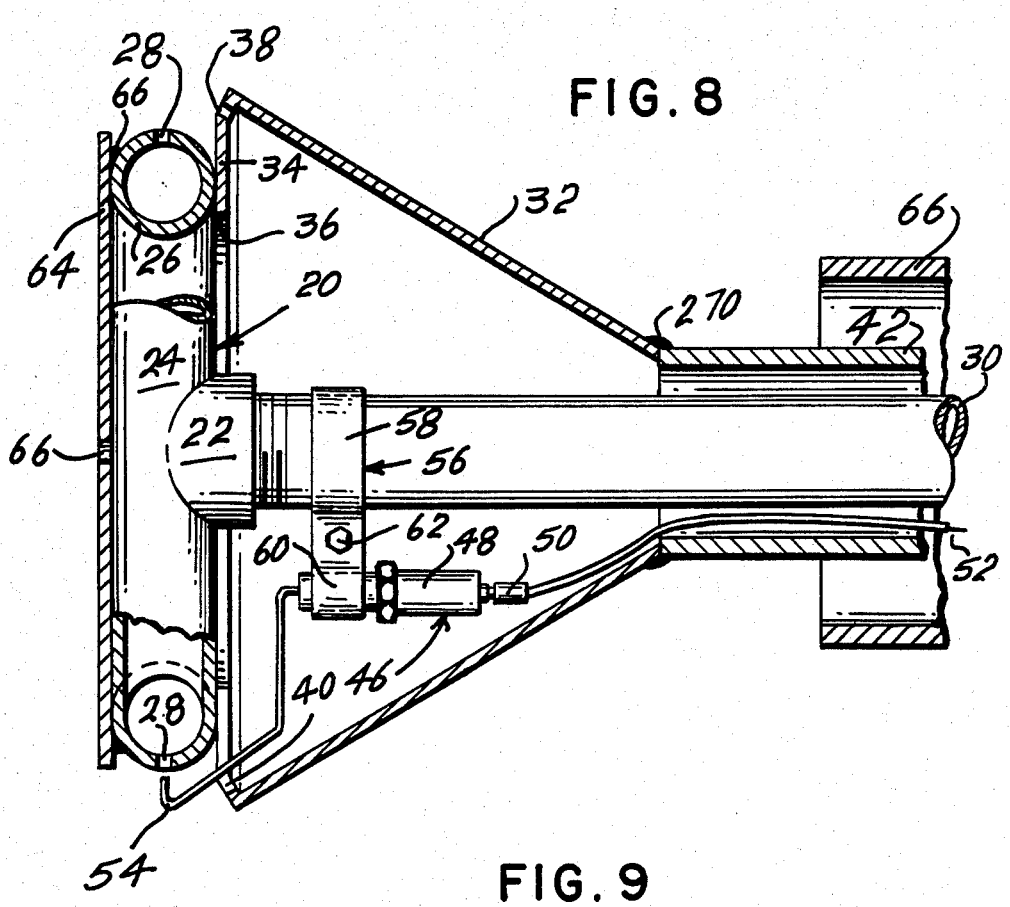
Figure 9:
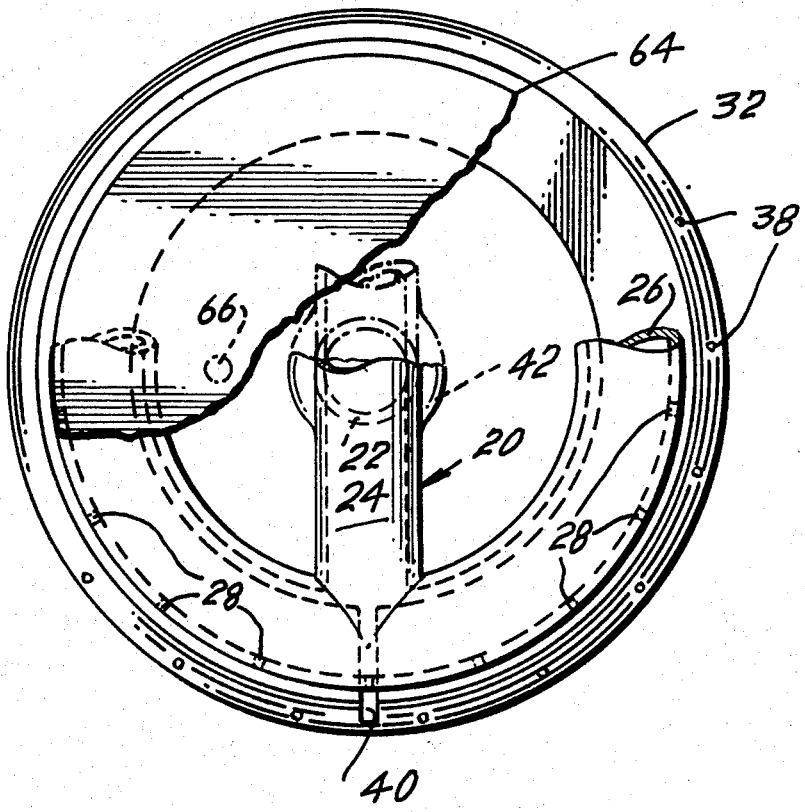
Figure 10:
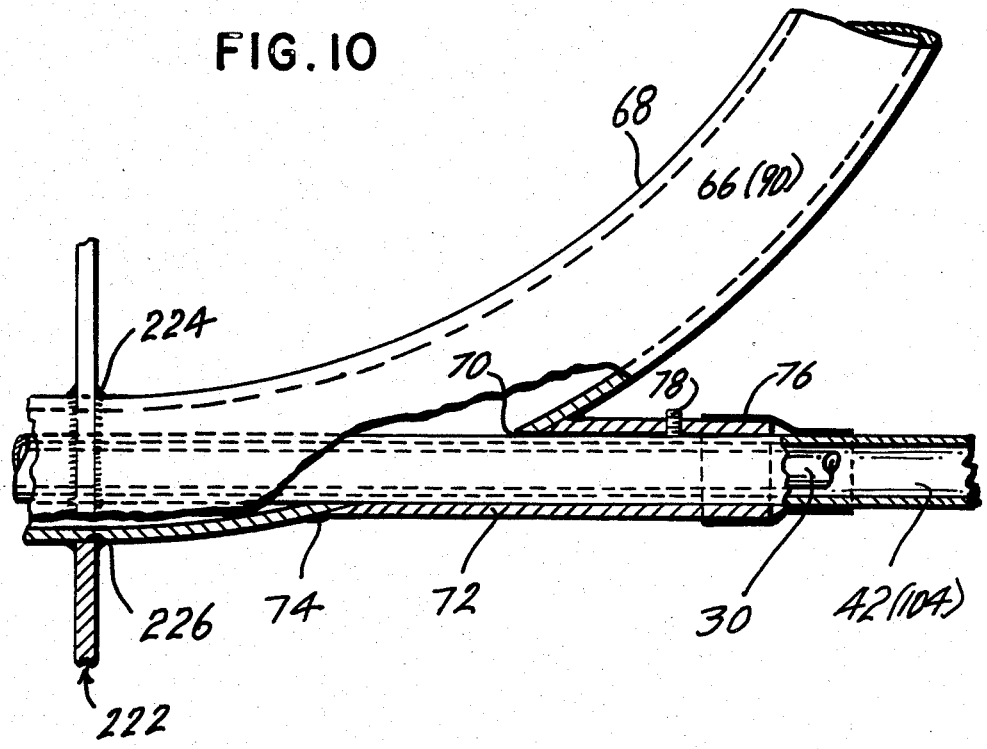

FIG. 1 is a fragmentary assembly view of a burner system in a refractory in a furnace and illustrates, in phantom, some of the positions of the burner ring and the burner head in order to assemble the burner head, and also illustrates the pipes for carrying comminuted material, flammable gas and air to the burner head for cooling the burner head;

FIG. 2 is an overall assembly view of the burner head and illustrates the various pipes and tubes for conveying the comminuted material, the flammable gas and the cooling air to the burner head, and also illustrates the flame pattern of the comminuted material and flammable gas, when appropriate, around the burner head and illustrates the burner head position near the refractory and also the front wall of the furnace;

FIG. 3, on an enlarged scale, is a fragmentary view illustrating, in detail, the igniter wire for igniting the flammable gas at the burner head and illustrates the positioning of the igniter wire between the pipe for conveying the flammable gas and the pipe for conveying the cooling air to the burner head;

FIG. 4, on an enlarged scale, is a fragmentary view illustrating the three concentric pipes or tubes and the centering pieces centering the smallest tubes for conveying the flammable gas inside of the middle size tube for conveying the cooling air and illustrates the middle size tube positioned by centering means inside of the largest tube for conveying the comminuted material which will undergo combustion;

FIG. 5, taken on Line 5—5 of FIG. 4, is a lateral cross-sectional view illustrating the centering means for centering the smallest tube for conveying the flammable gas inside of the middle size tube for conveying the cooling air;

FIG. 6, taken on Line 6—6 of FIG. 4, is a lateral cross-sectional view illustrating the set screws for locking the ends of the two adjacent pipes for carrying the comminuted material to the burner head and, also illustrates the medium size pipe for carrying the cooling air to the burner head and illustrates the smallest pipe for carrying the flammable gas to the burner head;

FIG. 7, taken on Line 7—7 of FIG. 4, is a lateral cross-sectional view illustrating the centering means for centering the middle size pipe inside of the largest pipe and space between the middle size pipe and the largest pipe is the space through which the comminuted material travels, and also illustrates the smallest pipe and the space between the smallest pipe and the middle size pipe is the space through which the cooling air travels and the flammable gas travels in the smallest pipe;

FIG. 8, on an enlarged scale, is a fragmentary view illustrating the diffuser cone, the burner head, the igniter, and the tubes for conveying the flammable gas, the cooling air and comminuted material and illustrates the diffuser cone for expanding outwardly the comminuted material across the burner head in an expanding cylindrical pattern;

FIG. 9 is a fragmentary end view looking at the circular burner and also looking toward the diffuser cone; and, FIG. 10 is a fragmentary view illustrating the connection between the large pipe through which the comminuted material flows, the middle size pipe through which the cooling air flows and the smallest pipe through which the flammable gas flows and illustrates the detail method for sealing the concentric pipes so as to assure the flow of the materials in the desired direction.

THE DETAILED DESCRIPTION OF THE INVENTION

With reference to the drawings, see FIGS. 8 and 9, it is seen that there is a TEE 20 having a half coupling 22 and a distributor 24. The distributor 24, on its two ends, connects with a circular ring 26. The circular ring 26 may be considered to be an igniter ring. On the periphery of the igniter ring 26 there are a number of orifices. The orifices 28 can be drilled. As will be seen in a latter part of the patent application the orifices 28 can be placed at various angles with respect to the igniter ring 26 so as to achieve a desired flame pattern and desired penetration of the flame into the stream of the comminuted material.

In FIG. 8 it is seen that the half coupling 22 connects with a pipe 30. The pipe 30 is threaded and is screwed into the half coupling 22. The pipe 30 carries the flammable gas to the tee 20 and the igniter ring 26.

There is a diffuser cone 32. As is seen in FIG. 8 the diffuser cone is in the configuration of a frustum of a cone. The diffuser cone has a base plate 34. In the base plate 34 there is a large circular cut-out 36. At the junction of the base plate 34 and the side of the diffuser cone 32 there are a plurality of peripheral orifices 38. Also, it is seen that in the lower part of the base plate 34 there is a slot 40.

The small end or the inner end of the diffuser cone 32 connects with a pipe 42. The pipe 30 is in a concentric relationship with the pipe 42. In that space between the pipe 30 and the pipe 42 the cooling air is conveyed. The cooling air flows through the diffuser cone 32 and out of the diffuser cone, mainly, through the peripheral orifices 38 and also through the slot 40.

The cooling air flowing through the pipe 42 and through the diffuser cone 32 serves two purposes. First, the cooling air cools the diffuser cone 32. Also, the cooling air acts as air for supporting combustion of the flammable gas flowing through the orifices 28 of the igniter ring 26.

In FIG. 9 it is seen that the peripheral orifices 38 are spaced so as to be, approximately, between the orifices 28 of the circular ring 26. Another way of expressing this is the peripheral orifices 38 are at the midpoint between the orifices 28 of the circular ring 26. The reason for this is to lessen the possibility of the cooling air exstinguishing the flammable gas flowing through the orifices 28 and the circular ring 26. Another way of expressing this is the spacing of the orifices 38 and the spacing of the orifices 28 optimises the stability of the igniter flame by minimizing the potential of extinguishing the flammable gas as it leaves the ring.

In FIG. 8 there is illustrated an igniter 46 for igniting the flammable gas escaping through the orifices 28 of the igniter ring 26. The igniter 46 can be of conventional construction comprising a spark plug 48. The spark plug 48 will accept a 10,000 volt A.C. current. There is connecting cap 50 connecting with one end of the spark plug 48. The connecting cap 50 also connects with an electric wire which connects with a transformer. On the other end of the spark plug 48 there is an electrode 54. The electrode 54 is positioned near, but separate and apart from, the igniter ring 26. The igniter ring 26 is grounded.

The spark plug 48 is positioned by means of a standard split pipe clamp 56. The pipe clamp 56 can be commercially purchased and comprises two halves having a large circular part 58 and a lower circular part 60. A bolt 62 can be used to unite the two halves. The large part 58 fits around the pipe 30 and the lower small part 60 fits around the spark plug 48. In FIG. 8, it is seen that the electrode 54 or the igniter wire 54 is specially shaped so as, on one end, to connect with the spark plug 48 and to pass through the slot 40. The other end of the electrode 54 is positioned near the igniter ring 26.

In FIGS. 8 and 9 it is seen that there is a heat deflector plate 64 secured to the gas ring by welding 66. The deflector plate 64 is in a circular configuration and is of a diameter approximately the outside diameter of the igniter ring 26. The deflector plate 64 can be fabricated of a special heat-resistant alloy such as stainless steel 330. Then, the outer surface of the deflector plate can be plasma sprayed with an inert high temperature material such as zirconium oxide to protect it from high temperature oxidation. In the deflector plate 64 there may be a number of passageways or orifices 66 to allow cooling air to flow through the deflector plate. As previously explained, the cooling air flows in the pipe 42 and contacts the sides of the diffuser cone 32 so as to cool the diffuser cone 32. Then, the cooling air flows through the peripheral orifices 38 and also the slot 40. In certain instances it may be desirable to have the cooling air flow through orifices 66 in the deflector plate 64.

In FIG. 8 it is seen that the pipe 42 is positioned inside of the largest pipe 66. The space between the outside of the pipe 42 and the inside of the pipe 66 is the space in which the comminuted material is forced, under pressure.

In FIG. 10 there is illustrated the manner of connecting the pipes 30, 42 and 66. In FIG. 10 it is seen that the pipe 66 has an upward curve 68. In the wall of the pipe 66 there is an opening 70. A pipe sleeve 72 is welded at 74 to the heel of the pipe 66. There is positioned in the pipe sleeve 72 the pipe 42 and in the pipe 42 there is positioned the pipe 30.

In FIG. 10 it is seen that there is a sealant 76 at the junction of the end of the sleeve 72 and that part of the pipe 42 near the end of the pipe sleeve 72. The sealant 76 can be sealing tape which is wrapped around the opening between the sleeve 72 and the pipe 42.

Also, in FIG. 10 it is seen that there is a place for set screws 78. Actually, there are three set screws 78 and these three set screws are positioned at angles of 120° spacing between them. The set screws 78 make it possible to definitely position the pipe 42 with respect to the sleeve 72 and also with respect to the largest pipe 66.

The largest pipe 66, see FIGS. 1, 4 and 6, is not one continuous pipe. It comprises an interior section 80 which terminates near the diffuser cone 32 and an exterior section 90 which comprises the curved portion 68 or that portion for receiving the pipe 42 and the pipe 30.

On the exterior end of the section 80 there is welded a coupling 82 by weld 84. Part of the coupling 82 projects outwardly and beyond the section 80. The outwardly projecting part of the coupling 82 is referred to by reference numeral 86 and is internally threaded at 88.

The inner end of the section 90 is externally threaded at 92. The exterior of section 90 can be screwed into the coupling 82. The threads on the coupling 82 and the exterior section 90 are long threads.

In the outwardly projecting part 86 of the coupling 82 there are three tapped openings 94 for receiving set screws 96 to lock the exterior section 90 with respect to the interior section 80. The set screws 96 are to prevent the vibration and working loose of the exterior of section 90 from the threaded interior of section 80.

In FIG. 4 and FIG. 7 it is seen that there are three centering pieces or tabs 98 on the interior surface of the exterior of section 90 for positioning the pipe 42 in, substantially, the center part of the largest pipe 66. Also, it is seen that the tabs 98 have a diagonal edge 100 so as to allow the pipe 42 to be readily moved forwardly, in FIG. 4, from right to left, and also to allow comminuted material and the like to pass the centering tabs 98 without being hung up or impeded in their flow of travel.

In FIGS. 1 and 4 it is seen that the pipe 42 is not one continuous piece but is made up of an interior section 102 which connects on its interior end with the diffuser cone 32. Then, there is an exterior section 104.

On the exterior or outer end of the section 102 there is a coupling 106 which is welded at 108 to the section 80. The coupling 108 has a part 110 projecting outwardly beyond the end of the section 80. This part 110 is internally threaded or tapped at 112.

The inner end of the exterior section 104 is externally threaded at 114. The threaded part 112 and the threaded part 114 are long threads.

The exterior section 104 is screwed into the coupling so as to abut against the end of the interior section 102.

The purpose of the long threads is to allow the two sections of pipe to be screwed together with the ends abutting against each other so that there is not a void or a lapse between the two ends of the two sections of pipe.

In the outwardly projecting part 110 of the coupling there are three tapped openings 116. In these tapped openings 116 are set screws for bearing against the outer surface of the outer section 104 so as to definitely position the pipe 104. This definite positioning of the pipe 104 means that with vibration the pipe will not become unthreaded or unscrewed from the coupling and move away from the end of the pipe 102.

In FIGS. 4 and 5 there is illustrated three centering pieces or three tabs 120. These tabs, substantially, position the pipe 30 in the central part of the pipe 43. Again, it is noted that the tabs have a leading diagonal edge for ease of moving the pipe 30 forwardly and into the pipe 42. Again, that space between the pipe 30 and the pipe 42 is for conveying air, which functions as a cooling gas as well as supporting combustion.

With reference to the pipes 30, 42 and 66 the reader is referred to FIGS. 1, 2 and 3. In these figures it is seen that there is a TEE 130 having a first tapped end 132. The middle size pipe 42, in particular, of the outer section 80, is threaded at 134 so as to be screwed into the tee 130.

The TEE 130 has a second tapped end 136 and a tapped third end 138.

There is screwed into the tapped third end 138 a threaded pipe 140. The threaded pipe receives a flexible hose 142. The flexible hose is positioned on the pipe 140 by means of a clamp 144.

There is a threaded pipe nipple 146 which is screwed into the second tapped end 136 of the tee 130. On the outer end of the nipple 146 there is a reducing plate 148. The reducing plate 148 is welded to the nipple 146 by weld 150.

In the center part of the plate 148 there is an opening 152 for receiving the smallest pipe 30.

There is welded a sleeve 154, at weld 156, to the outer surface of the reducing plate 148. In the sleeve 154 are three tapped openings 158 for receiving set screws 160 to definitely position the smallest pipe 30 in the sleeve 154. The purpose of the set screws 160 is to position the smallest pipe 30, axially, with respect to the pipe 42 and also with respect to the diffuser cone 32. Again, the purpose of the set screws 160 is to axially position the smallest pipe 30 within the middle size pipe 42 so as to also position the igniter ring 26 against the base plate 34 of the diffuser cone 32.

There is a sealant 162 wrapping around the outer end of the sleeve 154 and the adjoining outer surface of the smaller pipe 30. The sealant 164 can be a tape such as a plastic tape commonly used in the construction industry.

In the reducing plate 148 there is an opening 164. The electric wire or igniter wire 52 passes through said opening 164 and to the spark plug 48.

In FIG. 2 it is seen that the largest pipe 66, in particular, the exterior section 90, terminates in a flange 170. There is a pipe 172 which has a reducing flange 174 on its lower end and a flange 176 on its upper end. The flanges 170 and 174 are united so as to be flush and tight with respect to each other. Then, there is a pipe 178 which has a flange 180. The flange 180 and the flange 176 are united so as to be flush and tight with respect to each other.

The flanges 170 and 174 and the flanges 176 and 180 can be united with conventional means. For example, these flanges can be bolted and gasketed together.

It is to be noted that the diameter of the pipe 172 is smaller than the diameter of the pipe 66 or the exterior section 90. The reason for this is to have substantially the same conveying area or cross-sectional area in the pipe 172 as in the pipe 66 less the cross-sectional area taken by the pipe 42 inside the pipe 66. Another way of expressing this is to say that the largest pipe 66 is larger in cross-sectional area than the pipe 172 so as to compensate for the cross-sectional area taken up by the cooling pipe 42.

There is an elbow 182 having a first tapped end 184. The outer end of the smallest pipe 30 has a tapped end and is screwed into the first tapped end 184. Also, the elbow 182 has a second tapped end 186.

There is a flexible metal hose 188 having a union adapter fitting 190 which is threaded on its outer end for screwing into the second tapped end 186 of the elbow 182.

The largest pipe 66 connects with the source of combustible comminuted material. This comminuted material is forced under pressure through the pipe 66 and around the pipe 42 so as to contact the outer surface of the diffuser cone 32. The pressure in the largest pipe 66, as the comminuted material approaches the diffuser cone 32, can be in the neighborhood of one pound positive pressure.

The flexible hose 142 connects with the source of air. The air pressure of the air in the flexible hose 142 may be in the range of one or two inches of water. This is a, relatively, low pressure.

The flexible metal hose 188 connects with the source of combustible gas such as liquified petroleum gas or natural gas or water gas. The pressure of the gas in the flexible metal hose will vary depending upon the type of gas used and the heat output of the igniter ring 26. The pressure of the gas in the flexible metal hose 188 will be adjusted depending upon the availability and type of combustible gas or flammable gas.

In FIGS. 1 and 2 there is illustrated a heat exchanger 200 such as a furnace or a kiln. The furnace 200 has a shell or supporting metal structure comprising a front wall 202 and an outwardly projecting support 204. Then, there is a front wall 206, in FIGS. 1 and 2, to the right of the outwardly projecting support 204 and forming part of the shell or supporting metal structure.

In the front wall 206 there is an opening 208. Projecting inwardly from the opening 208 and towards the front wall 202 there is a supporting structure 210.

There is a wind box 212 or plenum 212 on the outside of the front wall 206. This wind box or plenum 212 can comprise a circular or rectangular housing 214. The housing 214 comprises a front wall 218. In the front wall 218 there is an opening 220.

There is a closure plate 222 covering the opening 220. The closure plate 222 may be attached to the plenum 212 by means of bolts connecting the closure plate 222 with the front wall 218.

The wind box 212 or plenum 212 is connected to the front wall 206 by a weld 224 or, in the alternative, can be bolted depending upon the circumstances.

In the closure plate 222 there is an opening 226. The largest pipe 66 projects through the opening 226 and is attached to the closure plate 222 by weld 228. There is an air diffuser 230 which is secured to the largest pipe 66 and can be placed in the opening 208. The purpose of the air diffuser is to impart rotation to the air entering into the heat exchanger 200 so that the air will mix more rapidly with the comminuted combustible material being introduced into the heat exchanger. The reader is to understand that in many instances it is not necessary to have an air diffuser 230. In certain installations it its desirable to have an air diffuser 230 but in other installations the air diffuser 230 is not required.

There is an air duct 232 connecting with the lower part of the plenum 212 so as to allow air to flow into the plenum 212 and then through the opening 208. The reader is to understand that the air duct 232 may connect with the wind box 212 at the top or side or any convenient location, depending upon the installation.

It is to be realized that the air duct 232 may connect with a fan for forcing air into the air duct 232 and then into the wind box 212.

The supporting structure 210 connects with a frustum of a cone 234. The frustum of the cone expands outwardly from the supporting structure 210 as it goes towards the heat exchanger 200. The shape of the frustum of the cone 234 is such as to radiate heat energy, at a right angle or normal, to the surface of the diffuser cone 32. The surface of the frustum of the cone 234 is shaped so as to be parallel to the outer surface of the diffuser cone 32 so as to optimise the transfer of heat energy by radiation from the surface of the cone 234 to the surface of the diffuser cone 32.

In many heat exchangers there is a refractory material and an insulating block. It is to be understood that not all heat exchangers have a refractory material or an insulating block. As illustrated in FIGS. 1 and 2 there is a refractory material 236 and an insulating block 238 between the refractory material 236 and the shell or supporting metal structure.

In FIGS. 1 and 2 it is seen that there is an outwardly projecting support 204.

It is seen that there is a passageway 240 leading from the frustum of the cone to the exterior of the outwardly projecting support 204 and through the front wall 206. A thermocouple 242 can be placed in this passageway 240 so as to monitor the temperature in the vicinity of the frustum of the cone 234 and the diffuser cone 32.

The thermocouple 242 serves a useful purpose as it allows a monitor to sense the temperature around the frustum of the cone 234 and the diffuser cone 32. Upon starting the burner in a cold furnace the flammable gas is introduced through the pipe 30 to the igniter ring 26. The flammable gas is ignited. Then, comminuted combustible material may be introduced through the largest pipe 66 so as to flow past the surface of the diffuser cone 32. The comminuted combustible material upon flowing past the surface of the diffuser cone 32 is expanded outwardly and in an outwardly expanding circular pattern. The position of the igniter ring 26 is near the outer end or the base of the diffuser cone 32 and inside the expanding circular pattern of the combustible material. The flammable gas from the igniter ring 26 contacts the comminuted combustible material so as to ignite this material. The reader is to realize that the flammable gas from the igniter ring 26 expands outwardly over a 360° pattern. This flammable gas expanding outwardly over the 360° pattern contacts the comminuted combustible material which is also expanding outwardly. The result of the flammable gas being inside of the circular flow pattern of the comminuted combustible material, in my opinion, means that far less gas is needed to initiate combustion of the comminuted combustible material as compared with the instance where an external gas ring, to the flow pattern of the comminuted combustible material, is used. By a gas ring which is external to the flow pattern of the combustible material I mean that this ring is directing flammable gas inwardly and that the combustible material flows inside of this external ring. I consider that this internal igniter ring 26 is superior to a point flame as there is a more complete diffusion of the flame, from the flammable gas, into the stream of the comminuted combustible material. I consider that this internal igniter ring is superior to a point flame or to a flame which is delivered to a very restricted part of the dust stream or comminuted combustible material stream. In contrast to the igniter ring of my invention it is to be understood that when there is an igniter delivering a flammable gas or a flame to a restricted area of the comminuted combustible material stream that there is not, substantially, instantaneous combustion of the material. It is to be realized that time is required for all of the combustible material to come up to ignition temperature. The combustible material is being carried into the furnace but the combustible material has not completely burned. It is, readily, understood that the sooner the combustible material is ignited the more desirable the combustion process. It is apparent that the sooner the combustible material is ignited there is a greater amount of time for the combustible material to burn to completion or to go to completion as contrasted with this when some or all of the combustible material is not immediately ignited there is a less period of time for the combustible material to burn to completion and as a result of this period of time there can be a release of excessive particulates to the atmosphere; there could be an excessive build-up of particulate matter on the exchanger surfaces; and, there have been instances where the build-up or accumulation of combustibles in the heat exchanger have subsequently resulted in an explosion. In FIGS. 1 and 2 it is seen that the flame pattern of the combustible gas is referred to by reference numeral 244 and that the flow of the comminuted combustible material as referred to by reference numeral 246. At the meeting place or intersection of the flammable gas 244 and the comminuted material 246 there results a flame pattern 248. In FIG. 2 it is seen that the combustible material 246 flows into the flame 244 so as to be ignited and there results a flame pattern which fully encompasses the diffuser cone 32 on a 360° basis. This insures an immediate ignition of the combustible materials so as to have the maximum time possible to complete burnout of the combustible material. The flammable gas is used when the heat exchanger 200 is cold and the ambient temperature surrounding the diffuser cone 32 is too low to fully ignite all of the combustible material entering into the frustum of the cone 234 and surrounding the diffuser cone 32. When the ambient temperature is too low to insure full combustion of the combustible material, such as in start-up of a cold heat exchanger, it is necessary to use the flammable gas and the igniter ring 26.

The monitor or the person looking after the furnace can use the thermocouple to determine when the ambient temperature conditions in area of the cone 234 and the diffuser cone 32 are high enough to initiate combustion of all of the comminuted combustible material then the monitor can discontinue the use of flammable gas and the igniter ring 26. The monitor can be an operating personnel for the furnace. In certain instances, instead of using a human being, the monitor may be an electrical-mechanical device or any other suitable device can be used to terminate the flow of flammable gas to the igniter ring 26 when favorable ambient conditions prevail.

An automatic control is, schematically, illustrated in FIG. 2. It is seen that there is a line 250 connecting with the thermocouple 242. The line 250 also connects with a signal conversion relay 252. The signal conversion relay 252 connects by means of aligning 254 with the valve 256. The valve 256 is in the incoming line 188. The valve 256 can be used for shutting off the flow of gas to the igniter ring 26 on signal from the conversion relay 252 and the thermocouple 242. Further, there may be a manual valve 258 in the line 188. An operator can manually shut off the valve or open the valve 258 to allow the flow of flammable gas to the igniter ring 26.

The feature of being able to shut off the flow of flammable gas to the igniter ring, when favorable ambient temperature conditions have been realized, means a considerable saving in the use of the flammable gas. As most flammable gas is derived from petroleum or is a by-product from the petroleum fields, such as propane and butane, there is a considerable saving in the use of petroleum product or by-product.

The components are not assembled and it is necessary to assemble these components for use in the heat exchanger 200. These components can be assembled outside of the heat exchanger 200 and, if necessary, on an adjoining floor. The components are designed to permit assembly outside of and away from the heat exchanger 200. The place of assembly can be any convenient place such as a work bench or a floor.

The first step in the assembly is to secure the interior section 80 to the exterior section 90 by screwing the two together until the ends meet and then setting set screws 96 to prevent rotation.

The second step is to insert the cooling air pipe, exterior section 104, through the pipe sleeve 72 and into the interior of the largest pipe 66. The insertion of the section 104 must be sufficient to clear the free end of the interior section 80 of the largest pipe 66.

The diffuser cone 32 is attached, by welding, to the interior section 102 so as to have an integral unit. Then, the interior section 102 and the exterior section 104 are screwed together so that the ends abut and touch each other. Then the set screws 108 can be turned in so as to prevent rotation of the adjacent pipes.

The next step is to install the electric wire igniter wire 52 through the opening 164 in the reducing plate 148 and run that wire in the pipe 42 so that it extends into the diffuser cone 32. One way of accomplishing this is to insert a rigid wire into the opening 162 and run it in the pipe 42 until it reaches the diffuser cone 32. It is to be recalled that in the base plate 34 of the diffuser cone 32 there is a large circular cut-out 36. The igniter wire can be attached to the rigid wire and drawn through the opening 164 and into the cavity in the diffuser cone 32.

Then, the smallest pipe 30 can be inserted through the opening 158 in the reducing plate 148 and inside of the pipe 42 until the end of this pipe extends beyond the base plate 34 of the diffuser cone 32. In other words, the end of the pipe 42 projects outwardly and beyond the diffuser cone 32. This is shown in FIG. 1, see the extreme phantom view of the pipe 42 and the igniter ring, on the left. Then, the igniter ring 26 is screwed onto the end of the pipe 42, again, see the extreme left phantom view in FIG. 1. The igniter ring 26 and the pipe 42 are tightly screwed together so as to prevent the leaking of flammable gas at the junction of the two.

The next step is to secure the spark plug 48 adjacent to the end of the pipe 42 and near the igniter ring 26 until the proper positioning of the electrode 54 is acheived with respect to the igniter ring 26. This is accomplished by means of the pipe clamp 56. With proper positioning the bolt is tightened and the spark plug is definitely positioned with respect to the pipe 42 and the electrode 54 is definitely positioned with respect to the igniter ring 26.

The next step is to attach the electric wire 52 to the spark plug 48. After this has been accomplished the igniter ring 26 can be moved towards the base 34 of the diffuser cone 32. It is to be remembered that upon moving the igniter ring 26 towards the base 34 the electrode 54 must be positioned in the slot 40 in the base plate 34. Concurrent with the movement of the igniter ring 26 towards the base plate 34 it is necessary to retract the electric wire igniter wire 52 in the pipe 42.

The igniter ring 26 is moved and positioned so that it fits snug and tight against the exterior surface of the base plate 34. Then, the set screws 160 can be tightened so as to definitely position the pipe 30 and the pipe 42 with respect to each other.

It is to be recalled that the closure plate 222 is welded to the largest pipe 66. With respect to FIG. 2 that portion of the largest pipe 66, to the left of the closure plate 222 and the diffuser cone 32 in the igniter ring 26 are inserted through the opening 220 in the plenum 212. Then, the closure plate 222 can be bolted to the plenum 212.

After the diffuser cone has been positioned with respect to the end of the largest pipe 66 the three set screws 78 can be tightened. The observer can observe the flame pattern. If the flame pattern is not the desired one or is in the wrong position the observer can loosen the three set screws 78 and move the pipe 42 so as to adjust the position of the diffuser cone 32 with respect to the end of the largest pipe 66. Then, the three set screws can again be tightened so as to definitely position the diffuser cone with respect to the largest pipe 66.

Previously, there has been mentioned the air diffuser 230. It is possible to not attach the air diffuser 230 to the largest pipe 66. In case it is desired to have the air diffuser 230 on the largest pipe 66 this must be attached before the diffuser cone 32 in the interior section 102 is screwed onto the exterior section 104.

In order for this system to operate it is necessary to connect the flange 170 on the end of the largest pipe 66 with the flange 174 of the pipe 172. This can be accomplished by bolting the two together. This assures a supply of comminuted combustible material to the heat exchanger 200.

Also, the flexible hose 142 is positioned over the pipe 140 and the clamp 144 attached to securely position together these two members.

Then, the union adapter fitting 190 can be screwed into the second end 186 of the elbow 182 to securely position these two together.

Assume that the furnace is hot and operating and that it is desirable to remove the diffuser cone 32 and the igniter ring 26 from the heat exchanger 200. With my invention it is possible to remove the hot diffuser cone and the hot igniter ring 26 from the heat exchanger 200. This can be accomplished in the reverse manner to the assembly of the members. For example, the union adapter fitting adapter 190 can be unscrewed from elbow 182. The clamp 144 can be removed and the flexible hose 142 removed from the pipe 140. The flanges 174 and 170 can be disconnected so that the largest pipe 66 can be removed. Then, the closure plate can be removed from the plenum 212 and the largest pipe 66 of the diffuser cone 32 and the igniter ring moved out of the frustum of the cone 234, through the opening 208 and through the opening 220 and out onto the floor or to a work bench. After the diffuser cone 32 and the igniter ring have cooled it is possible to do any required work.

With respect to FIG. 1 it is understood that the diameter of the opening, denoted by $d_2$, is of a larger diameter than the opening denoted by $d_1$, 208 leading to the frustum of the cone 234. It is to be understood that the diameter of the opening $d_2$ is always larger that the diameter of the largest part of the assembly, in this case the diameter of the air diffuser 230 and the diameter of the opening 208.

It is possible to burn comminuted combustible material with my burner head and igniter ring. Most combustible material comprises carbon and hydrogen. An example of combustible material which can be burned with my invention is a cellulose-based product such as wood and paper. Another example is rubber. The rubber is secured from old tires. The old tires, often, difficult to dispose of. It is possible to reduce the size of the rubber tires so that they will pass through a 16 minus mesh screen or have a small dimension of one millimeter. In processing the rubber tires for burning with my invention the tires are reduced in size and it is to be realized that along with the rubber there are small particles of steel, cotton, artificial fibers such as rayon, nylon and polyester. The rubber is the main constituent but there are the minor amounts of other materials used in the rubber tires. In regard to the cellulose-based material, there are many places where wood is difficult to dispose of. For example, at a shake mill there are large pieces of cedar which have to be disposed of. In years past there have been used wigwam burners to dispose of waste wood. One of the drawbacks of a wigwam burner is the large amount of pollutants entered into the air and into the atmosphere due to incomplete combustion of the wood. Also, considerable wood is wasted and which could be used as a fuel. Also, there is bark which can be comminuted and burned. At the present time much of the bark is spread out on the ground so as to form a fill. Further, there are other pieces of wood which, in many places at the present time, are spread out on the ground just as a land fill. Likewise, sawdust is spread out on the ground as a land fill as there is not a better use for it or a more economical use for it at the particular location. Further, in our society there is considerable paper and this paper must be disposed of. The paper can be reduced in size and then burned in my invention.

In my invention using the suspension firing of a comminuted combustible material I consider that with 30% excess air that there is used about 105 cubic feet of air per pound of cellulose-based material such as wood dust and small particles of wood. In regard to rubber with 30% excess air I consider that there is required about 190 to 195 cubic feet of air per pound of small particles of rubber. The size of the material to be burned in my suspension firing system can vary with the type of heat exchanger. If the heat exchanger is a large heat exchanger and there is a long time in which the combustible material can burn then the particle size of the combustible material can be, relatively, large. However, if the heat exchanger is a small heat exchanger and there is only a short time in which the combustible material can be burned then the combustible material must be of fine particle size, say, 16 minus mesh or a size of one millimeter or less.

My burner and system optimises the potential for initiating combustion of the material and thereby increases the probability that the combustible material will be completely burned. The maximum capability of any suspension firing system is to provide for immediate combustion of combustible material in the combustion space. With my system I consider that my burner head, in conjunction with the refractory, makes it possible to provide for immediate combustion of the combustible material.

As previously stated there is the igniter ring 26 having orifices 28 which direct the flammable gas outwardly. There results a flame pattern of 360° . The comminuted material in an expanding circle so as to encompass 360° is introduced to said circular flame pattern. Again, the flame pattern is inside of the combustible material. I consider that with the flame pattern of the flammable gas being inside the ring of combustible material that there is more complete burning of the combustible material so as to realize a greater degree of heat energy from the combustible material. With the flame pattern being inside the pattern of the combustible material I consider that it is possible to have a good mix of the flame and the combustible material. The orifices in the igniter ring 26 can be spaced and also be placed at such an angle as to have a desired flame pattern. For example, the orifices may be so located as to direct the flame pattern toward the diffuser cone 32 or may be located to direct the flame pattern away, to a degree, from the diffuser cone 32. Further, it is seen in FIG. 9 that the orifices 28 for the flammable gas are staggered so as to be between the orifices 38 for the cooling air flowing through the diffuser cone 32.

By having the refractory in the configuration of the frustum of a cone and with the walls substantially parallel to the outer surface of the diffuser cone 32 I consider that there is better utilization of the heat energy from the refractory. This heat energy assists in the immediate ignition of the comminuted material flowing toward the diffuser cone 32. Also, the refractory around the diffusor cone 32 functions as a thermal flywheel. After the refractory has reached the desired temperature it is not necessary to use flammable gas. The introduction of comminuted combustible material between the surface of the diffuser cone 32 and the refractory, with the refractory at the desired temperature, will insure the immediate ignition and combustion of the combustible material. As a result there is a saving in the use of a gas such as liquified petroleum gas and natural gas. In many installations which do not use my invention it is necessary to use a flammable gas to sustain ignition and combustion of the comminuted material being burned. With my invention, after the temperature of the refractory has reached the desired temperature, due to the thermal flywheel effect, it is not necessary to use a flammable gas as the combustion is self-sustaining and there is immediate ignition of the combustible material upon entering the area between the diffuser cone and the refractory.

It is possible to direct my burner head in any reasonable position. The burner head can be directed to be horizontal or can be directed to be pointed downwardly or pointed upwardly or pointed at one side or the other. In certain installations this versatility of direction of the burner head can be valuable.

Further, I consider that my invention has certain safety features. For example, in many installations where there is a suspension firing of combustible material the combustible material is conveyed to the area of firing with sufficient air to support complete combustion.

Under certain unfortunate, circumstances it may be possible to have a burning of the combustible material while being conveyed with the air, and before reaching the heat exchanger or furnace. With my invention the comminuted combustible material is forced through the largest tube 66 in a mixture with gas, viz., air, comprising oxygen, with the ratio of the comminuted combustible material to the gas always providing less oxygen than needed to support complete combustion. The ratio of the gas to the comminuted combustible material being in the range not to exceed about 55 cubic feet of the gas to one pound of the combustible material. The air for combustion and the combustible material mix in the refractory chamber. In other words, the air for combustion and the combustible material mix at the area where ignition and combustion is to occur.

With my invention and burner I consider that there is an increase in the efficiency of burning comminuted combustible material. I consider that there is an increase in the efficiency of a dutch oven and also in the efficiency of a stoker. In many installations hog fuel, vis., scraps of wood and combustible material, are introduced to a grate and burned to generate steam. This is usually a low temperature combustion. Also, the burning of the hog fuel is, generally, not a complete combustion. Also, the burning of the hog fuel is, generally, not a complete combustion. There result pollutants which are introduced into the atmosphere and also there results some particulate matter condensing out and forming on the boiler tubes. Further, there is not a complete burning of the hog fuel and therefore there is not a complete realization of the heat energy latent in the hog fuel. With my invention I consider that the use of my burner in conjunction with a dutch oven or with the stoker used for burning hog fuel that there is a more complete combustion of the products from the hog fuel and therefore less pollution emitted to the atmosphere from a heat exchanger and also less possibility of particulate matter condensing out on the boiler tubes. A stoker can be used for burning the hog fuel and in conjunction with the stoker there can be used my burner. My burner makes it possible to have a more complete combustion of the combustible material. As a result there may be a 10% to 15% increase in the amount of steam produced per unit of fuel, with my burner as compared with a stoker and grates for hog fuel. With an increase in the amount of steam produced per unit of fuel there is greater efficiency in utilizing the fuel. Further, I consider that my burner makes it possible to raise the temperature in the heat exchanger and therefore increase the amount of steam produced. Another benefit of the use of my burner is that it is not necessary to use as much oil or natural gas and therefore there is a conservation of oil and natural gas.

In an existing furniture mill, dry fuel is being fired in suspension with a spreader stoker. The fuel consists of hogged wood waste, dry wood shavings and sander dust, all of which is introduced into the furnace with a stoker. The fines in the dry wood shavings and the sander dust are fine and light in weight and upon reaching the furnace they are carried upward with the furnace gases in the upward flowing gas stream. Little of this fuel reaches the grate, and, unfortunately, is not completely burned when it leaves the furnace. Heating value is lost and smoke and particulate matter escapes to the atmosphere because of the incomplete combustion.

With my burner, this fine material would be combusted cleanly, a hotter fire would result and the other dry wood products would be more completely burned so as to lessen pollutants and to realize greater efficiency from the combustible material.

Another manner of considering the foregoing is that a stoker may produce a dirty fire with a lot of pollutants while my suspension burner will produce a clean fire. By utilizing my suspension burner with the stoker the incomplete combustion products in the dirty fire are more completely burned so as to decrease the amount of particulate matter.

I consider some of the main advantages of my invention to be the capability of removing the burner head from a hot heat exchanger and make repairs or alterations to the burner head while the heat exchanger is still hot. It is not necessary to cool the heat exchanger to remove the burner head and make the desired alterations. Another feature I consider to be of value is the suspension firing of the comminuted combustible material without the use of an auxiliary fuel such as fuel oil or natural gas. This results in a conservation of fuel oil and natural gas. Another feature I consider to be of value is that with my suspension burner there is a more complete combustion of the combustible material so as to have less particulate matter in the effluent gases from the heat exchanger and furnace.

In certain instances my burner head and unit may be used in conjunction with other firing means in a heat exchanger. For example, as previously explained, my burner head may be used in conjunction with a stoker for hog fuel or some other means for firing hog fuel. It may be desirable not to use my burner head under certain situation. It is to be realized that if the burner head is in a furnace and subject to heat conditions and is not being used there is the possibility of deterioration of the burner head. Therefore, it is necessary to cool the burner head, even though the burner head is not being used. There is provision for this as pipe 42 conveys cooling air to the diffuser cone 32 and the cooling air can escape from the diffuser cone 32 through the orifices 38. In this manner the burner head is cool and there is less possibility of the burner head suffering damage and becoming deteriorated when in a furnace and not being used. For example, one of these situations may be when there is not suitable comminuted combustible material for suspension firing with my burner head.

Further, the operator may find that it is desirable not to have cooling gas flow through the tube 42 into the diffuser cone 32 even though there is a flammable gas flowing from the igniter ring and even though comminuted combustible material is flowing through the largest tube 66 to the diffuser cone 32. Therefore, the operator has the ability to stop the flow or prevent the flow of cooling air through the tube 42 to the diffuser cone 32. In certain instances, by not having cooling air flow through the tube 42 to the diffuser cone 32 the diffuser cone 32 reaches a higher temperature which aids in the immediate ignition of the comminuted combustible material flowing in the direction of the diffuser cone 32.

As previously stated, the diffuser cone 32 connects with the interior section 102 of the pipe 42 by means of a weld 270. In use the diffuser cone 32 may deteriorate. In order to replace such a diffuser cone the interior section 102 can be unscrewed from the exterior section 104 and another diffuser cone screwed onto the exterior of section 104. In this manner the deteriorated diffuser cone can be, easily, replaced with another diffuser cone.

By having this diffuser cone 32 attached to the interior of section 102 of pipe, it is possible to use ordinary materials of construction with the other components of my burner system, other than the heat deflector plate 64. By attaching the diffuser cone 32 in this manner there is greater flexibility in both the assembly of my burner system and also the disassembly of my burner system.

The comminuted combustible material can be a mixture of fuels such as a cellulose based material and a plastic, viz., rubber.

In preparing this patent application I did not make a patent search.

From the foregoing and having presented my invention what I claim is:

1. A burner head comprising:

a. A first means for directing a flammable gas in an outwardly direction;

b. a second means for directing a cooling gas toward said flammable gas;

c. a third means for directing a comminuted combustible material toward said gas;

d. said first means comprising an igniter ring having a number of first peripheral orifices;

e. a means to introduce said flammable gas to said igniter ring;

f. said second means comprising a housing having a number of second orifices;

g. a means to introduce said gas comprising oxygen into the interior of said housing;

h. said igniter ring being positioned adjacent to said housing;

i. said first orifices and said second orifices being so positioned as to direct said flammable gas and said gas comprising oxygen toward each other; and j. said third means comprising a means to direct said comminuted combustible material on the outside of said housing and toward said gas comprisng oxygen.

2. A burner head comprising:

a. a first means for directing a flammable gas in an outwardly direction;

b. a second means for directing a cooling gas toward said flammable gas;

c. a third means for directing a comminuted combustible material toward said gas;

d. said first means comprising an igniter ring having a number of first peripheral orifices;

e. a first pipe to introduce said flammable gas to said igniter ring;

f. said second means comprising a cone having a base;

g. said igniter ring being positioned adjacent to said base;

h. said cone having a number of second orifices;

i. a second pipe to introduce said gas comprising oxygen to the interior of said cone;

j. said first orifices and said second orifices being so positioned as to direct said flammable gas and said gas comprising oxygen toward each other;

k. said third means comprising a third pipe for directing said comminuted combustible material to the outside of said cone and toward said gas comprising oxygen; and, l. said first pipe being inside of said second pipe and said second pipe being inside of said third pipe.

3. A combination of a refractory and a burner head:

A. said burner head comprising:

I. a first menas for directing a flammable gas in an outwardly direction;

II. a second means for directing a cooling gas toward said flammable gas;

III. a third means for directing a comminuted combustible material toward said gas;

B. said refractory comprising:

IV. a surface positioned close to said burner head;

C. said burner head comprising:

V. said first means comprising an igniter ring having a number of first peripheral orifices;

VI. a first pipe to introduce said flammable gas to said igniter ring;

VII. said second means comprising a cone having a base;

VIII. said igniter ring being positioned adjacent to said base;

IX. said cone having a number of second orifices;

X. a second pipe to introduce said gas comprising oxygen to the interior of said cone;

XI. said first orifices and said second orifices being so positioned as to direct said flammable gas and said gas comprising oxygen toward each other;

XII. said third means comprising a third pipe for directing said comminuted combustible material to the outside of said cone and toward said gas comprising oxygen;

XIII. said first pipe being inside of said third pipe;

D. said refractory comprising:

XIV. a conical surface; and,

XV. said conical surface being substantially parallel to said second means comprising a cone.

4. A burner head comprising:

a first means for directing a flammable gas in an outwardly direction;

b. a second means for directing air toward said flammable gas to form a mixture of said air and said flammable gas;

c. a third means for directing a second mixture of a comminuted combustible material and air toward said first mixture;

d. said first means comprising an ignitor ring having a number of first peripheral orifices;

e. a means to introduce said flammable gas to said ignitor ring;

f. said second means comprising a housing having a number of second orifices;

g. a means to introduce said gas comprising oxygen into the interior of said housing;

h. said ignitor ring being positioned adjacent to said housing;

i. said first orifices and said second orifices being so positioned as to direct said flammable gas and said gas comprising oxygen toward each other; and, j. said third means comprising a means to direct said comminuted combustible material on the outside of said housing and toward said gas comprising oxygen.

5. A burner head comprising:

a. a first means for directing a flammable gas in an outwardly direction;
b. a second means for directing air toward said flammable gas to form a mixture of said air and said flammable gas;
c. a third means for directing a second mixture of a comminuted combustible material and air toward said first mixture;
d. said first means comprising an ignitor ring having a number of first peripheral orifices;
e. a first pipe to introduce said flammable gas to said ignitor ring;
f. said second means comprising a cone having a base;
g. said ignitor ring being positioned adjacent to said base;
h. said cone having a number of second orifices;
i. a second pipe to introduce said gas comprising oxygen to the interior of said cone;
j. said first orifices and said second orifices being so positioned as to direct said flammable gas and said gas comprising oxygen toward each other;
k. said third means comprising a third pipe for directing said comminuted combustible material to the outside of said cone and toward said gas comprising oxygen; and,
l. said first pipe being inside of said second pipe and said second pipe being inside of said third pipe.

6. A combination of a refractory and a burner head:
A. said burner head comprising:
I. a first means for directing a flammable gas in an outwardly direction;
II. a second means for directing air toward said flammable gas to form a first mixture of said air and said flammable gas;
III. a third means for directing a second mixture of a comminuted combustible material and air toward said first mixture to form a third mixture;
B. said refractory comprising:
IV. a surface positioned close to said burner head to radiate heat energy toward said third mixture;
C. said burner head comprising:
V. said first means comprising an igniter ring having a number of first peripheral orifices;
VI. a first pipe to introduce said flammable gas to said igniter ring;
VII. said second means comprising a cone having a base;
VIII. said igniter ring being positioned adjacent to said base;
IX. said cone having a number of second orifices;
X. a second pipe to introduce said gas comprising oxygen to the interior of said cone;
XI. said first orifices and said second orifices being so positioned as to direct said flammable gas and said gas comprising oxygen toward each other;
XII. said third means comprising a third pipe for directing said comminuted combustable material to the outside of said cone and toward said gas comprising oxygen;
XIII. said first pipe being inside of said second pipe and said second pipe being inside of said third pipe;
D. said refractory comprising:
XIV. a conical surface; and,
XV. said conical surface being substantially parallel to said second means comprising a cone.

7. A burner assembly comprising:
a. an ignitor;
b. a housing;
c. said ignitor being positioned adjacent to said housing;
d. a first conveying means;
e. a second conveying means;
f. a means to allow said second conveying means to be separated into two members;
g. said first conveying means being positioned inside of said second conveying means;
h. a means to permit said first conveying means to be positioned in said second conveying means;
i. said ignitor connecting with one of said conveying means;
j. said housing connecting with the other one of said conveying means;
k. a third conveying means;
l. a means to permit said third conveying means to be separated into two members;
n. said housing connecting with said second conveying means;
o. said housing increasing in outside dimension with an increase in distance from said second conveying means to have an outside dimension larger than the outside dimension of said third conveying means;
p. said ignitor connecting with said first conveying means; and,
q. part of said first conveying means being in said housing.

8. A burner assembly according to claim 7 and comprising:
a. said igniter being an igniter ring; and,
b. said igniter ring having an outside dimension larger than the outside dimension of said third conveying means.

9. A burner assembly according to claim 8 and comprising:
a. said igniter ring having a number of peripheral orifices for directing a first stream of gas in an outwardly direction; and,
b. said housing having a number of second orifices for directing a second stream of gas toward said first stream of gas.

10. A burner assembly according to claim 8 and comprising:
a. said third conveying means bending to form a curve;
b. said third conveying means being a tube having a wall;
c. a first passageway in said wall; and,
d. said first conveying means and said second conveying means projecting through said first passageway to have part of said first conveying means and part of said second conveying means inside of said third conveying means and part of said first conveying means and part of said second conveying means outside of said third conveying means.

11. A burner assembly according to claim 8 and comprising:
a. a means to allow the positions of said first conveying means and said second conveying means in said third conveying means to be changed.

12. A burner assembly according to claim 10 and comprising:
a. said first conveying means being capable of conveying a flammable gas;
b. said second conveying means being capable of conveying air; and,
c. said third conveying means being capable of conveying a mixture of air and a comminuted combustible material wherein the ratio of said air in said mixture to said comminuted combustible material does not exceed about 55 cubic feet of said air in said material to 1 pound of said comminuted combustible material.

* * * * *